US007681999B2

(12) United States Patent
Ito et al.

(10) Patent No.: US 7,681,999 B2
(45) Date of Patent: Mar. 23, 2010

(54) INK-JET PRINTING HEAD

(75) Inventors: Atsushi Ito, Nagoya (JP); Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 797 days.

(21) Appl. No.: 11/334,385

(22) Filed: Jan. 19, 2006

(65) Prior Publication Data

US 2006/0158487 A1 Jul. 20, 2006

(30) Foreign Application Priority Data

Jan. 20, 2005 (JP) ..... 2005-013166

(51) Int. Cl.
*B41J 2/045* (2006.01)

(52) U.S. Cl. ..... 347/71; 347/68

(58) Field of Classification Search ..... 347/47, 347/68–72

See application file for complete search history.

(56) References Cited

U.S. PATENT DOCUMENTS

| | | | | |
|---|---|---|---|---|
| 4,947,184 | A * | 8/1990 | Moynihan | 347/45 |
| 5,402,159 | A | 3/1995 | Takahashi et al. | |
| 6,045,215 | A * | 4/2000 | Coulman | 347/47 |
| 6,193,360 | B1 | 2/2001 | Nishiwaki et al. | |
| 6,250,753 | B1 | 6/2001 | Nishiwaki et al. | |
| 6,447,107 | B1 * | 9/2002 | Chino et al. | 347/71 |
| 6,712,454 | B2 * | 3/2004 | Okuda | 347/65 |
| 2004/0001124 | A1 * | 1/2004 | Ito | 347/71 |

FOREIGN PATENT DOCUMENTS

| | | |
|---|---|---|
| JP | 3402349 | 3/1992 |
| JP | 4341853 | 11/1992 |
| JP | 200311356 | 1/2003 |
| JP | 200425636 | 1/2004 |

* cited by examiner

*Primary Examiner*—Stephen D Meier
*Assistant Examiner*—Geoffrey Mruk
(74) *Attorney, Agent, or Firm*—Baker Botts, LLP.

(57) ABSTRACT

An ink-jet printing head having a cavity unit, the cavity unit including a plurality of nozzles for ejecting an ink, a plurality of pressure chambers communicating with the respective nozzles, a common manifold chamber for distributing the ink into the plurality of pressure chambers, and a flexible plate having the plurality of nozzles and including a wall portion which partly defines the common manifold chamber and which constitutes a damper portion, wherein the damper portion absorbs a pressure wave of the ink propagating from each selected one of the pressure chambers to the common manifold chamber, when the ink in each selected pressure chamber is pressurized to eject the ink from the corresponding nozzle.

11 Claims, 5 Drawing Sheets

INK-JET PRINTING HEAD

The present application is based on Japanese Patent Application No. 2005-013166 filed Jan. 20, 2005, the contents of which are incorporated herein by reference.

BACKGROUND OF THE INVENTION

1. Field of the Invention

The present invention relates to an ink-jet printing head applicable to an image-recording apparatus arranged to perform a recording operation on a recording medium, with an ink delivered from nozzles.

2. Discussion of Related Art

There is known an ink-jet printing head of a type including a cavity unit and a piezoelectric actuator formed on the cavity unit. The cavity unit has a common manifold chamber from which an ink supplied from an ink supply source is distributed to a plurality of pressure chambers through which the ink is delivered to respective nozzles. When the ink in the selected pressure chambers is pressurized by the piezoelectric actuator, the pressurized ink in each selected pressure chamber is fed to the corresponding nozzle, and is ejected from this nozzle.

In the ink-jet printing head constructed as described above, each pressure chamber is in communication with both of the corresponding nozzle and the common manifold chamber, so that a pressure wave of the ink generated upon pressurization of the ink in the pressure chamber by the piezoelectric actuator has not only a forward component propagating toward the nozzle, but also a rearward component propagating toward the common manifold chamber. The rearward component of the pressure wave generates a so-called "cross talk" in which the rearward component propagates to the other nozzles through the common manifold chamber. This cross talk causes degradation of printing quality of the ink-jet printing head. To prevent the cross talk, it is known to provide the common manifold chamber with a damper which absorbs the rearward component of the pressure wave.

For example, JP-2003-11356 A (FIGS. 2-5) and US 2004001124 A1 (FIGS. 2 and 3) corresponding to JP-2004-25636 A disclose a cavity unit consisting of a plurality of plates laminated o each other, which include a nozzle plate having nozzles, a damper plate having a damper chamber, and a manifold plate having a common manifold chamber. The manifold plate and the damper plate are laminated on each other such that the common manifold chamber and the damper chamber are located adjacent to each other in the direction of lamination of those plates. In this arrangement, the cavity unit has a smaller surface area in cross section taken in a plane perpendicular to the direction of lamination, than in an arrangement in which the common manifold chamber and the damper chamber are formed in a single plate such that these two chambers are located adjacent to each other in the direction perpendicular to the direction of lamination of the cavity unit. Accordingly, the ink-jet printing head has a reduced overall size.

Described in greater detail, the cavity unit disclosed in JP-2003-11356 A uses the manifold plate formed of a metallic material such that the common manifold chamber takes the form of a recess which is formed in the manifold plate and which is partly defined by a thin bottom wall. The manifold plate is laminated on the damper plate such that the thin bottom wall of the recess serves as a top wall of the damper chamber. On the other hand, the cavity unit disclosed in US 2004001124 A1 uses the damper plate formed of a metallic material such that the damper chamber takes the form of a recess which is formed in the damper plate and which is partly defined by a thin top wall. The manifold plate is laminated on the damper plate such that the thin top wall of the damper chamber serves as a bottom wall of the common manifold chamber. In both of these cavity units, one of the opposite surfaces of the above-described thin wall partly defines the common manifold chamber while the other surface of the thin wall is exposed to an air space. In this arrangement, the rearward component of the pressure wave propagating from the pressure chamber to the common manifold chamber through a communication hole is absorbed by oscillation of the above-described thin wall of the metallic material.

In the cavity units disclosed in the above-identified two publications wherein the pressure wave propagating to the common manifold chamber is absorbed by the metallic thin wall, it is necessary to form the thin wall with a minimum thickness and/or a relatively large surface area, for effectively absorbing the pressure wave by a sufficiently large magnitude of oscillation of the thin wall.

However, there is a limitation in the reduction of the thickness of the thin wall with high accuracy by increasing the thickness of the above-described recess formed in the metallic manifold plate or damper plate. Further, an increase of the surface area of the thin wall gives rise to a problem of an increased size of the ink-jet printing head.

SUMMARY OF THE INVENTION

The present invention wad made in an effort to solve the problems experienced in the prior art. It is therefore an object of the present invention to provide an ink-jet printing head which is easy and economical to manufacture and small-sized and which permits effective absorption of the pressure wave of the ink propagating from the pressure chambers to the common manifold chamber.

The object indicated above can be achieved according to one aspect of the present invention, which provides an ink-jet printing head having a cavity unit, the cavity unit comprising a plurality of nozzles for ejecting an ink, a plurality of pressure chambers communicating with the respective nozzles, a common manifold chamber for distributing the ink into the plurality of pressure chambers, and a flexible plate having the plurality of nozzles and including a wall portion which partly defines the common manifold chamber and which constitutes a damper portion, wherein the damper portion absorbs a pressure wave of the ink propagating from each selected one of the pressure chambers to the common manifold chamber when the ink in each selected pressure chamber is pressurized to eject the ink from the corresponding nozzle.

In the ink-jet printing head according to the first aspect of this invention constructed as described, the damper portion absorbs the pressure wave propagating from the pressure chambers to the common manifold chamber, thereby preventing a cross talk between the nozzles which would take place due to the pressure wave propagating through the common manifold.

The damper portion is constituted by the flexible plate having the nozzles formed therethrough, more precisely, by the wall portion of the flexible plate which partly define the common manifold chamber. That is, the damper portion is provided by utilizing the flexible plate which is provided in the cavity unit of the ink-jet printing head, as a plate in which the nozzles are formed. Accordingly, the cavity unit can be fabricated with a reduced number of component plates and with a reduced overall thickness.

The object indicated above can also be achieved according to another aspect of this invention, which provides an ink-jet printing head having a cavity unit, the cavity unit comprising a plurality of nozzles for ejecting an ink, a plurality of pressure chambers communicating with the respective nozzles, a common manifold chamber for distributing the ink into the plurality of pressure chambers, a first plate formed of a flexible resin material and provided with a gas-impermeable film, and a damper portion which is constituted by a wall portion of the first plate which partly defines the common manifold chamber, the damper portion absorbing a pressure wave of the ink propagating from each selected one of the pressure chambers to the common manifold chamber when the ink in each selected pressure chamber is pressurized to eject the ink from the corresponding nozzle.

In the ink-jet printing head according to the second aspect of this invention constructed as described, the damper portion absorbs the pressure wave propagating from the pressure chambers to the common manifold chamber, thereby preventing a cross talk between the nozzles which would take place due to the pressure wave propagating through the common manifold.

The first plate is provided with the gas-impermeable film, to prevent entry of air into the common manifold chamber through the damper portions, and consequent generation of air bubbles in the common manifold chamber, even where the damper portion is formed of a gas-permeable resin material. Accordingly, the gas-impermeable film prevents a failure of ejection of the ink from the nozzles due to the air bubbles.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
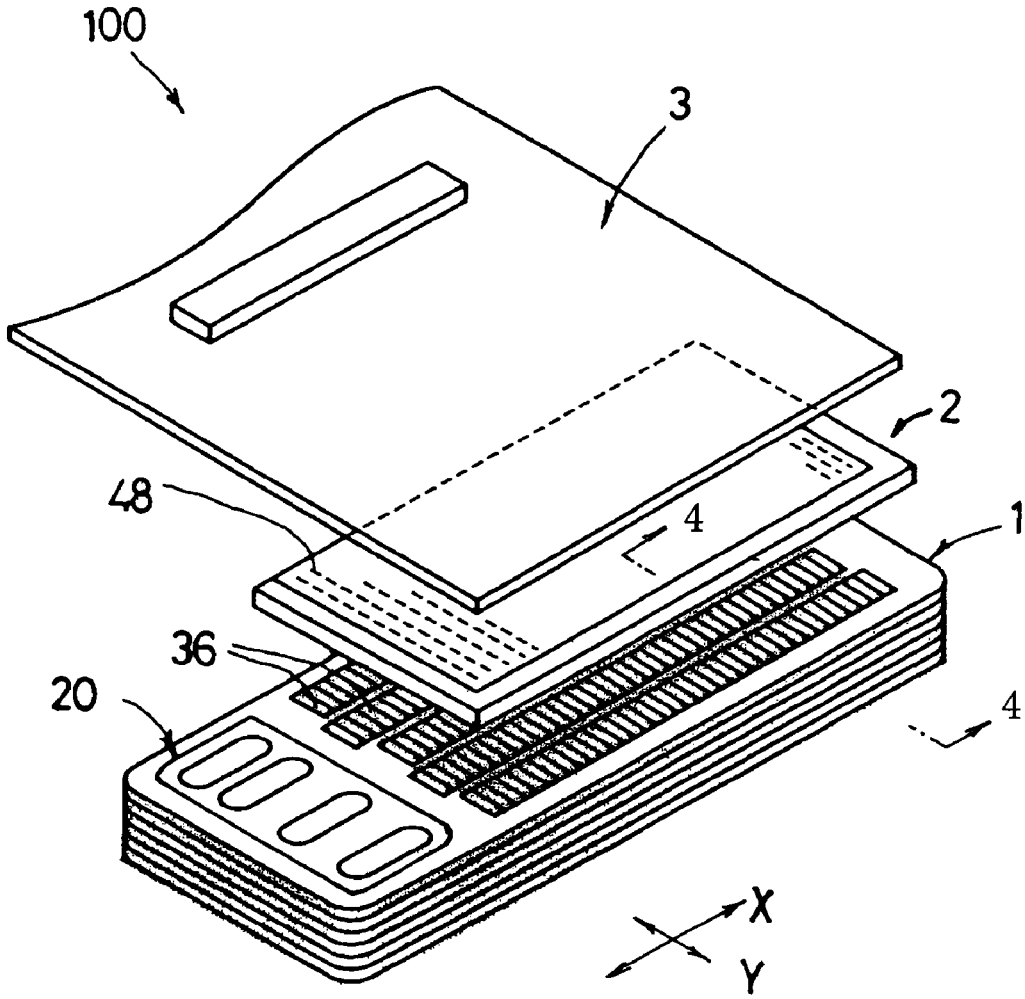
FIG. 1 is a perspective view of an ink-jet printing head constructed according to a first embodiment of this invention.
Figure 2:
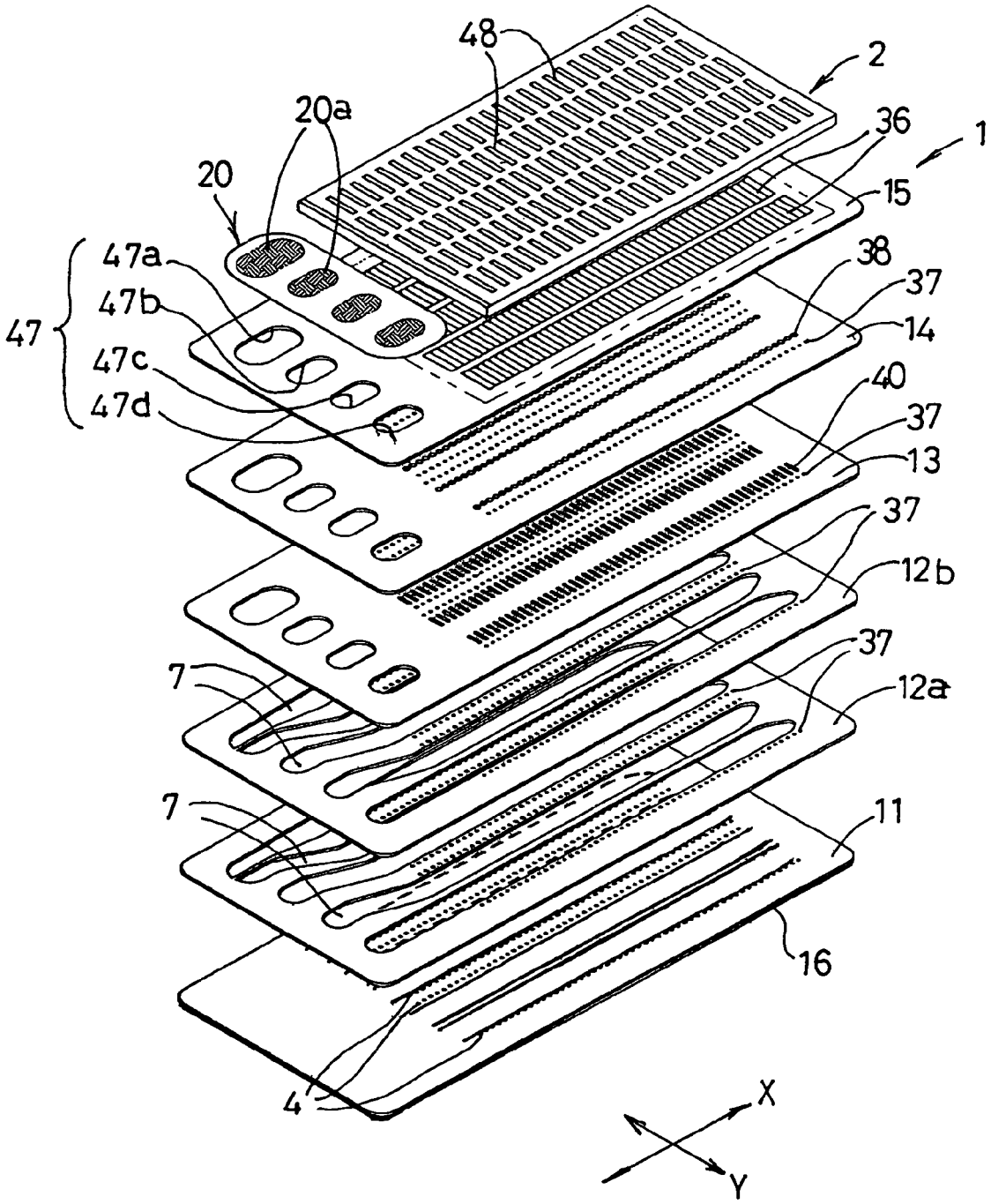
FIG. 2 is an exploded perspective view of the ink-jet printing head.

Referring to FIGS. 1-4, there will be described a first preferred embodiment of the present invention in the form of a piezoelectric ink-jet printing head 100. As shown in the perspective view of FIG. 1, the ink-jet printing head 100 includes a cavity unit 1 and a piezoelectric actuator 2. The piezoelectric actuator 2 of plate type is laminated on the cavity unit 1 consisting of a plurality of plates, and a flexible flat cable 3 (also shown in FIG. 4) for electrical connection of the printing head 100 to an external device is laminated on the upper surface of the piezoelectric actuator 2 of plate type. As shown in FIG. 2, the cavity unit 1 has nozzles 4 open in its lower surface, for ejecting an ink in the downward direction.

As also shown in FIG. 2, the cavity unit 1 is a laminar structure constituted by a total of six thin plates laminated on each other with an adhesive agent. The six thin plates consist of a nozzle plate 11 serving as a first plate; two manifold plates 12*a*, 12*b* serving as a second plate; a supply plate 13 serving as a fourth plate; a base plate 14; and a cavity plate 15 serving as a third plate.

In the present embodiment, each of the plates 11-15 has a thickness of about 50-150 μm, and the nozzle plate 11 is a flexible plate formed of a synthetic resin, while the other plates 12-15 are 42%-nickel alloy steel plates. The nozzle plate 11 has a multiplicity of ink ejecting nozzles 4 which are formed by laser machining, for example, and which have an extremely small diameter (about 20-23 μm). The nozzles 4 are arranged in five parallel straight rows such that the nozzles 4 in each row are spaced apart from each other by an extremely small spacing distance in the longitudinal direction of the nozzle plate 11 (in the X-axis direction), such that the corresponding nozzles 4 in the adjacent two rows are positioned relative to each other in a zigzag or staggered fashion, that is, offset from each other in the X-axis direction.

Figure 3:
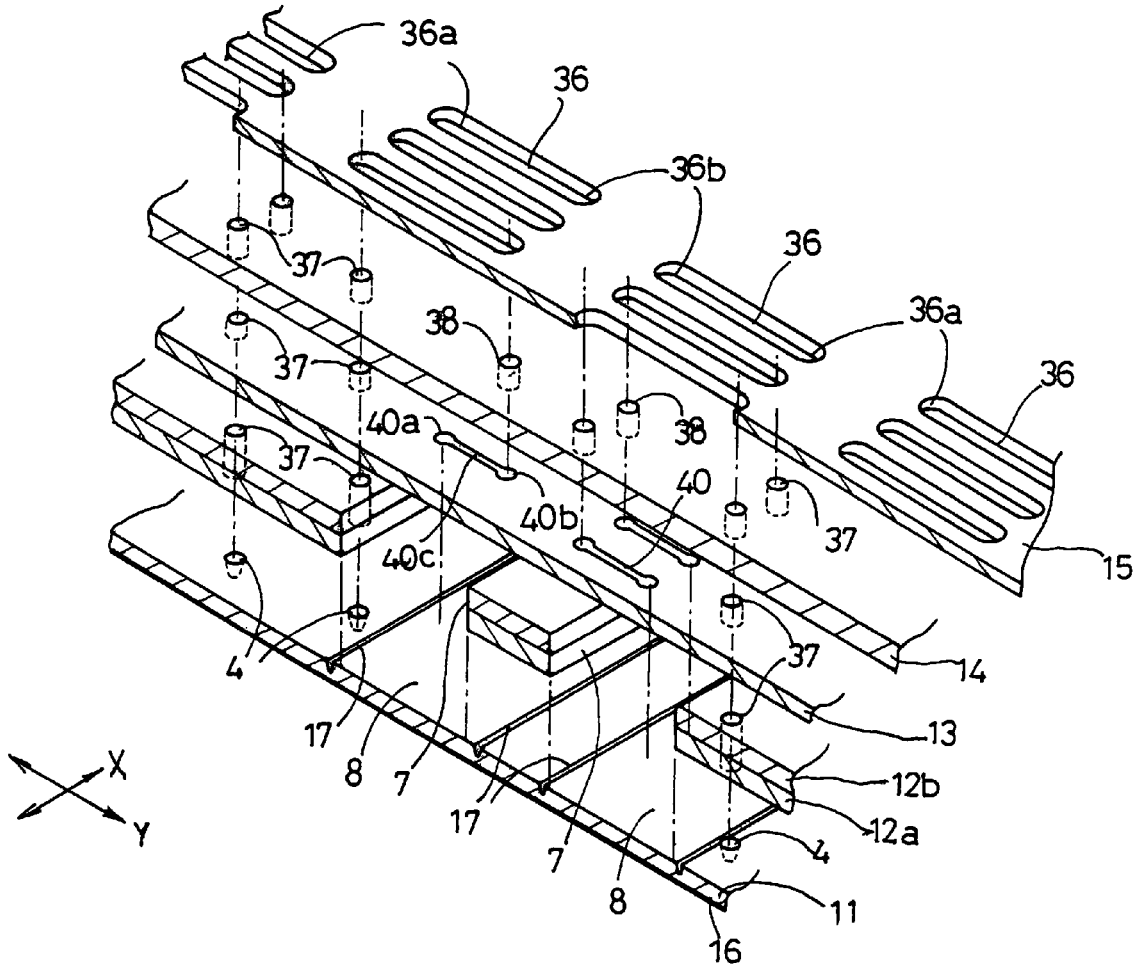
FIG. 3 is an enlarged, exploded perspective view of a cavity unit of the ink-jet printing head.

The cavity plate 15 has a multiplicity of through-holes forming a multiplicity of pressure chambers 36 arranged in five parallel straight rows such that the pressure chambers 36 in the adjacent two rows are positioned relative to each other in a zigzag fashion, that is, offset from each other in the X-axis direction. As shown in FIGS. 2 and 3, each pressure chamber 36 has an elongate rectangular shape as seen in the plane of the cavity plate 15, having a longitudinal direction parallel to a transverse direction of the cavity plate 15 (parallel to the Y-axis direction). The pressure chamber 36 is held in communication at one (36*a*) of its opposite longitudinal end portions 36*a*, 36*b* with the corresponding nozzle 4, and at the other longitudinal end portion 36*b* with a corresponding one of five manifold chambers 7 (which will be described).

The longitudinal end portion 36*a* of each pressure chamber 36 is held in communication with the corresponding nozzle 4 through a corresponding one of connecting passages 37 which are formed through the base plate 14, supply plate 13 and two manifold plates 12*a*, 12*b* such that the connecting passages 37 are arranged in five parallel straight rows in a zigzag fashion, like the nozzles 4.

The base plate 14 in contact with the lower surface of the cavity plate 15 has through-holes 38 in communication with the other longitudinal end portions of the respective pressure chambers 36.

The supply plate 13 in contact with the lower surface of the base plate 14 has communication holes 40 for supplying the ink from the common manifold chambers 7 to the pressure chambers 36. Each communication hole 40 has an inlet end portion 40*a* in communication with the corresponding common manifold chamber 7, an outlet end portion 40*b* in communication with the above-described through-hole 38 communicating with the corresponding pressure chamber 36, and an intermediate flow-restricting portion 40*c* located between the inlet and outlet end portions 40*a*, 40*b*. The flow-restricting portion 40*c* has a smaller cross sectional surface area than the inlet and outlet end portions 40*a*, 40*b*, so that a resistance to a flow of the ink through the flow-restricting portion 40*c* is larger than a resistance to flows of the ink through the inlet and outlet end portions 40*a*, 40*b*.

Figure 4:
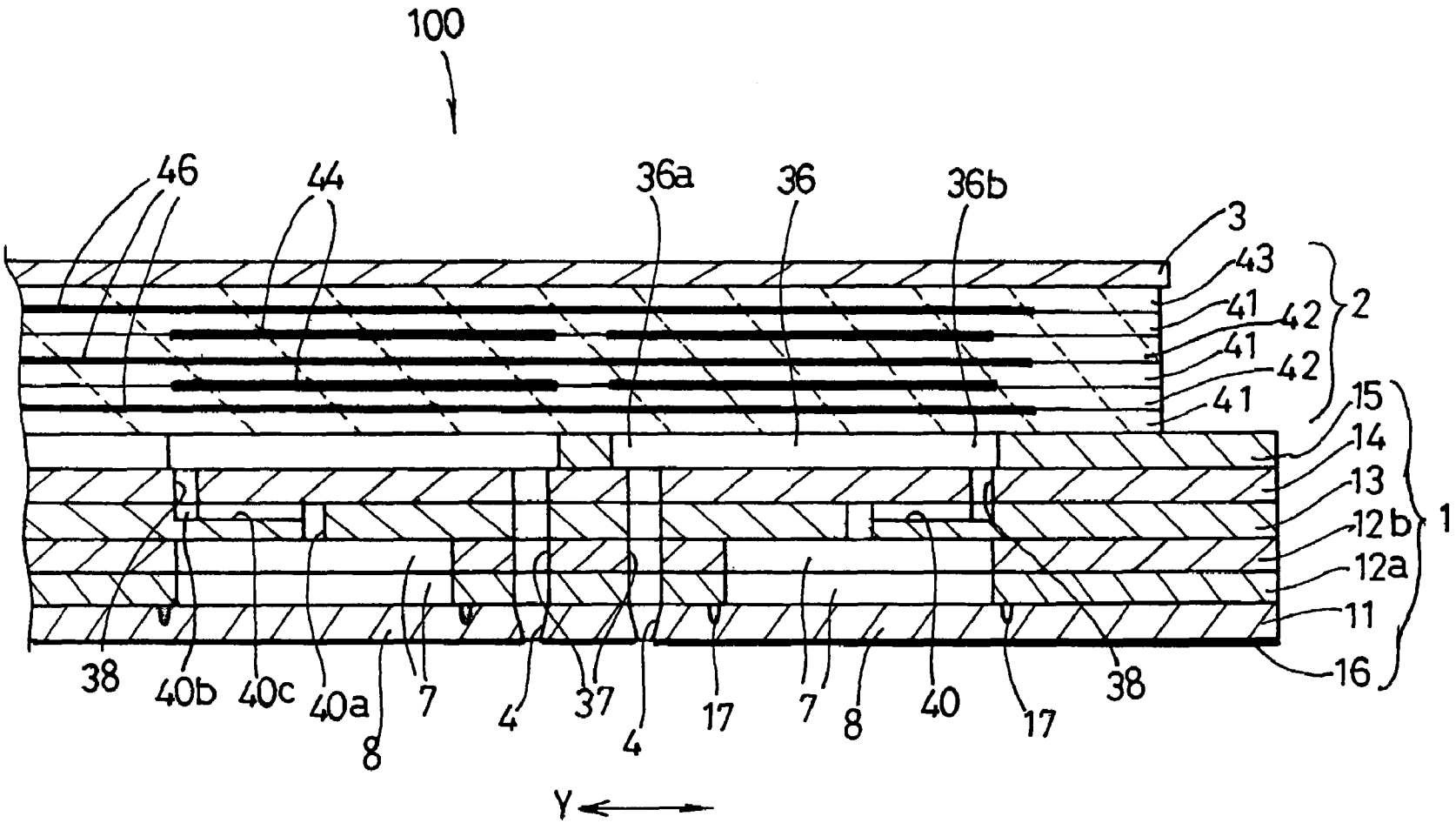
FIG. 4 is an enlarged elevational view in cross section taken along line 4-4 of FIG. 1.

The two manifold plates 12*a*, 12*b* have the five elongate common manifold chambers 7 formed through their thicknesses, so as to extend in their longitudinal direction (in the X-axis direction) in parallel to the five rows of nozzles 4. As shown in FIGS. 2 and 4, the two manifold plates 12*a*, 12*b* superposed on each other have five through-holes which are closed at their upper openings by the upper supply plate 13 in contact with the upper surface of the upper manifold plate 12*b*, and at their lower openings by the lower nozzle plate 11 in contact with the lower surface of the lower manifold plate 12*a*, whereby the five common manifold chambers 7 are fluid-tightly formed by the plates 12*a*, 12*b*, 13, 11. Each common manifold chamber 7 extends in the direction of extension of the corresponding row of pressure chambers 36 (in the direction of extension of the corresponding row of nozzles 4), such that the width of the common manifold chamber 7 partially overlap the pressure chambers 36 in the longitudinal direction of the pressure chambers 36.

As described above, the lower surface of the lower manifold plate 12*a* is held in contact with the nozzle plate 11, so that the flexible nozzle plate 11 formed of the synthetic resin serves as the bottom wall of each common manifold chamber 7. That is, the portions of the nozzle plate 11 which serve as the bottom walls of the common manifold chambers 7 serve as damper portions 8, as shown in FIGS. 3 and 4. Namely, the damper portions 8 are constituted by the wall portions of the nozzle plate 11 which partly define the common manifold chambers 7. The damper portions 8 function to absorb the pressure waves of the ink propagating from the pressure chambers 36 to the common manifold chambers 7. In the present embodiment, the nozzle plate 11 which is the lowermost layer of the cavity unit 1 exposed to the atmosphere is formed of a polyimide resin having gas permeability. To prevent air permeation through this gas-permeable nozzle plate 11 into the common manifold chambers 7, a metal film 16 is formed as a gas-impermeable film on the lower surface of the nozzle plate 1 which correspond to the damper portions 8.

In the present embodiment, the metal film 16 is formed on a substantially entire area of the lower surface of the nozzle plate 11 (over the entire lower surface area of the nozzle plate 11 except the portions in which the nozzles 4 are open). However, the metal film 16 need not cover the substantially entire area of the lower surface of the nozzle plate 11, and may be formed on only those portions of the lower surface which correspond to the damper portions 8. Namely, the metal film 16 must be formed on at least the above-indicated portions of the lower surface of the nozzle plate 11, to prevent the air permeation into the common manifold chambers 7 through the nozzle plate 11. Alternatively, the metal film 16 may be formed on the upper surface of the nozzle plate 11 on the side of the upper manifold plate 12*a*. The metal film 16 is formed on the nozzle plate 11 of polyimide resin by electroforming (electroplating) or vapor deposition process, with a thickness as small as about several microns (μm), and does not deteriorate the flexibility of the damper portions 8. Where the nozzle plate 11 is formed of a flexible material having gas impermeability, it is not necessary to form the metal film 16 or other gas-impermeable film on the nozzle plate 11.

To permit easier deformation of the damper portions 8 of the nozzle plate 11 as compared with the other portion, the nozzle plate 11 is provided with generally elongate weak portions 17 extending generally along the longitudinally extending opposite edges of the common manifold chambers 7. In the present embodiment, the weak portions 17 take the form of straight grooves formed in the upper surface of the nozzle plate 11 on the side of the lower manifold plate 12*a*, such that the grooves extending along the longitudinally extending opposite edges of the common manifold chambers 7 are located slightly outwards of those opposite edges, as shown in FIG. 4. In this case, the dimension of each damper portion 8 in the longitudinal direction of the cavity unit 1 is defined by a distance between the two adjacent grooves and is slightly larger than that of the corresponding manifold chamber 7. However, the weak portions 17 are not limited to the grooves, but may be a plurality of through-holes spaced apart from each other with a suitable spacing distance. These through-holes are arranged in parallel straight rows extending in the longitudinal direction of the common manifold chambers 7, or arranged along the entire periphery of each common manifold chamber 7.

As shown in FIG. 2, each of the cavity plate 15, base plate 14 and supply plate 13 has four through-holes formed in one of its longitudinally opposite end portions such that the four ink supply ports 47 in the three plates 13-15 are aligned with each other in the planes of these plates, to thereby form four ink supply ports 47. Inks of different colors supplied from ink supply sources are delivered through the ink supply ports 47 to the longitudinal end portions of the common manifold chambers 7, which end portions correspond to the longitudinal end portions of the plates 13-15 in which the ink supply ports 47 are formed. The four ink supply ports 47 are individually denoted by reference signs 47*a*, 47*b*, 47*c* and 47*d*, respectively, in the order as seen in FIG. 2 in the right direction.

In the present embodiment wherein the four ink supply ports 47 are provided while the five common manifold chambers 7 are provided, as shown in FIG. 2, the ink supply port 47*a* is communicated with the first two adjacent common manifold chambers 7 to which the blank ink is delivered. In this respect, it is noted that the black ink is used more frequently or consumed in a larger amount than the inks of the other colors, namely, yellow, magenta and cyan inks, which are delivered to the other three common manifold chambers 7 through the other three ink supply ports 47*b*, 47*c*, 47*d*, respectively. The cavity plate 15 is provided with a filter 20 bonded thereto with an adhesive agent, such that four filtering portions 20*a* of the filter 20 are aligned with the upper open ends of the respective four ink supply ports 47*a*, 47*b*, 47*c*, 47*d*, as shown in FIGS. 1 and 2.

As shown in FIG. 4, the piezoelectric actuator 2 is a laminar structure consisting of a plurality of piezoelectric sheets 41-43 each having a thickness of about 30 μm, as shown in FIG. 4, like a piezoelectric actuator provided in an ink-jet printer as disclosed in U.S. Pat. No. 5,402,159 A (corresponding to JP-4-341853 A). The piezoelectric sheets 42, which are the even-numbered sheets as counted from the lowest sheet of the laminar structure, have elongate individual electrodes 44 formed on their upper surfaces (upper one of the opposite major surfaces of each sheet 42), such that the individual electrodes 44 are aligned with the respective pressure chambers 36 of the cavity unit 1, and are arranged in parallel straight rows extending in the longitudinal direction of the piezoelectric actuator 2 (in the X-axis direction). The piezoelectric sheets 41, which are the odd-numbered sheets as counted from the lowest sheet, have common electrodes 46 formed on their upper surfaces. Each of these common electrodes 46 corresponds to a plurality of the pressure chambers 36. The piezoelectric sheet 43, which is the uppermost sheet of the laminar structure, surface electrodes 48 formed on its upper surface, as shown in FIGS. 1 and 2. The surface electrodes 48 consist of surface electrodes aligned with and electrically connected to the respective individual electrodes 44, and surface electrodes electrically connected to the common electrodes 46. As known in the art, the portions of the piezoelectric sheets 41, 42 which are located between the individual electrodes 44 and the common electrodes 46 are polarized upon application of a high voltage therebetween, so that these portions function as active portions.

Before the piezoelectric actuator 2 of plate type is bonded to the cavity unit 1, a sheet (not shown) of a suitable adhesive agent in the form of an ink-impermeable synthetic resin is bonded to the lower surface (lower one of the opposite major surfaces) of the piezoelectric actuator 2 which is to face the pressure chambers 36. Through this sheet of the adhesive agent, the piezoelectric actuator 2 is bonded to the cavity unit 1 such that the individual electrodes 44 are aligned with the respective pressure chambers 36. Further, the flexible flat cable 3 described above is bonded under pressure to the upper surface of the piezoelectric actuator 2, as shown in FIG. 4, such that wiring patterns (not shown) of the flexible flat cable 3 are electrically connected to the surface electrodes 48.

In the ink-jet printing head 100 constructed as described above, the inks are delivered from the ink supply ports 47 to the nozzles 4 through ink flow passages. That is, the ink of each color is introduced from the corresponding ink supply port or ports 47 into the corresponding common manifold chamber or chambers 7, and is distributed to the individual pressure chambers 36 through the communication holes 40 formed through the supply plate 13, and through the through-holes 38 formed through the base plate 14. When the active portions of the piezoelectric actuator 2 are selectively polarized and displaced, the ink in the pressure chambers 36 corresponding to the displaced active portions is pressurized, and a pressure wave (more precisely, its forward component) of the pressurized ink propagates from the pressure chambers 36 to the corresponding nozzles 4 through the corresponding connecting passages 37, whereby the ink is ejected from the nozzles 4. At this time, the pressure wave (more precisely, its rearward component) propagates from the pressure chambers 36 also to the common manifold chambers 7 through the through-holes 38 and the communication holes 40. However, the bottom wall of each common manifold chambers 7 which is opposed to the inlet end portion 40*a* of the corresponding communication hole 40 functions as the damper portion 8, which is oscillated to effectively absorb the pressure wave, thereby preventing the cross talk which would take place due to the pressure wave propagating to the common manifold chamber 7.

The nozzle plate 11 is formed of a resin material, for facilitating the formation of the nozzles 4 therethrough, and is the lowermost plate of the cavity unit 1. In view of these facts, the damper portions 8 are not provided by adding a damper plate formed of a resin material, but are provided by utilizing this nozzle plate. In particular, the polyimide resin used for the nozzle plate 1 in the present embodiment has relatively high degrees of resistance to the ink and formability of the nozzles 4 by laser machining, for example, and a considerably high degree of flexibility which assures a sufficiently large magnitude of oscillation of the damper portions 8. Further, the lowermost nozzle plate 11 is exposed at its lower surface to the atmosphere, it is not necessary to form an air space within the cavity unit 1 such that the damper portions 8 are exposed to the air, to facilitate the deformation or flexing of the damper portions 8, as in the known ink-jet printing heads. Accordingly, the present cavity unit 1 can be formed at a reduced cost, with a reduced number of component plates, and with a reduced overall thickness in the direction of lamination of the plates.

Figure 5:
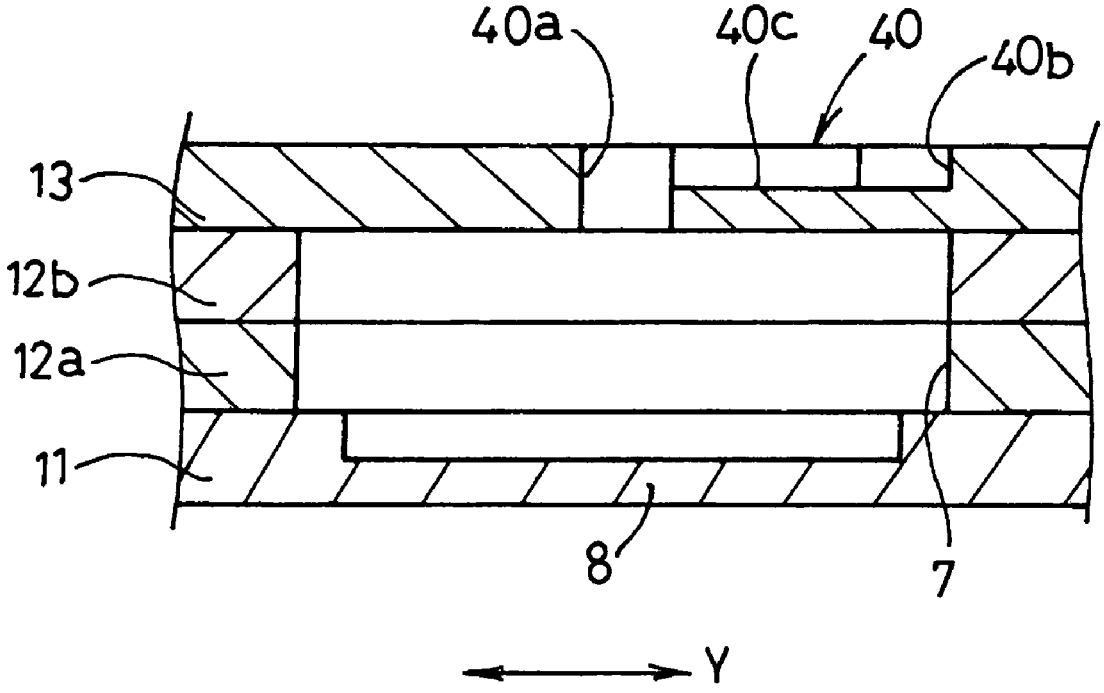
FIG. 5 is a fragmentary elevational view in cross, section showing a damper portion of the cavity unit, which is used in a second embodiment of the invention.

It is also appreciated that the damper portions 8 formed of a synthetic resin having a lower degree of rigidity than metals are able to oscillate by an amplitude sufficient to effectively absorb the pressure wave of the ink, even where the damper portions 8 have a smaller surface area than the damper portions of the known cavity units. The damper portions 8 provided by the nozzle plate 1 may have a smaller thickness than the other portion of the nozzle plate 1, as shown in FIG. 5, for easier deformation or flexing of the damper portions 8. In this the cavity unit 1 according to a second embodiment of the invention wherein the relatively thin damper portions 8 have a higher degree of oscillation, the dimension of each damper portion 8 in the Y-axis direction (in the longitudinal direction of the cavity unit 1) is made smaller than that of the common manifold chambers 7. In this respect, it is noted that the required longitudinal dimension of each common manifold chamber 7 in the X-axis direction is determined by the number of the nozzles 4 in the corresponding row, so that a possible amount of reduction of the longitudinal dimension of the common manifold chamber 7 is limited. According to the principle of the present invention, however, the dimension of the damper portions 8 in the Y-axis direction can be reduced while assuring a sufficient damping effect of the damper portions 8, so that the dimension of the common manifold chambers 7 can be accordingly reduced, whereby the overall dimension of the ink-jet printing head 100 in the Y-axis direction can be reduced, and an ink-jet head assembly including a plurality of the ink-jet printing heads 100 can be fabricated with a comparatively high degree of density of the printing heads 100.

The oscillation of the damper portions 8 is further facilitated by the weak portions 17, which are formed in the nozzle plate 11 to permit easier deformation of the damper portions 8. However, the weak portions 17 need not be provided.

The damper portions 8 are provided with the gas-impermeable film in the form of the metal film 16, to prevent entry of air into the common manifold chambers 7 through the damper portions 8, and consequent generation of air bubbles in the common manifold chambers 7, even where the damper portions 8 are formed of a gas-permeable resin material. Accordingly, the gas-impermeable film prevents a failure of ejection of the ink from the nozzles 4 due to the air bubbles. The gas-impermeable film may be formed on only those portions of the lower surface of the nozzle plate 11 which correspond to the respective damper portions 8, except the areas in which the nozzles 4 are formed.

Although the damper portions 8 are provided by the nozzle plate 11 in the illustrated embodiment, the damper portions 8 may be provided by adding a flexible plate in addition to the nozzle plate 11. In this case, the flexible plate which provides the damper portions 8 serves as the first plate.

While the piezoelectric actuator 2 is used in the illustrated embodiment as an actuator for pressurizing the ink in the selected pressure chambers 36, the actuator is not limited to the piezoelectric type.

It will be understood that the present invention is not limited to the details of the illustrated embodiment, but may be embodied with various changes and modifications, which may occur to those skilled in the art, without departing from the spirit and scope of the present invention defined in the following claims.

What is claimed is:

1. An ink-jet printing head having a cavity unit, said cavity unit comprising:

a plurality of nozzles for ejecting an ink;

a plurality of pressure chambers communicating with the respective nozzles;

a common manifold chamber for distributing the ink into the plurality of pressure chambers; and a flexible plate having said plurality of nozzles and including a wall portion which partly defines said common manifold chamber and which constitutes a damper portion, wherein said damper portion absorbs a pressure wave of the ink propagating from each selected one of said pressure chambers to said common manifold chamber, when the ink in said each selected pressure chamber is pressurized to eject the ink from the corresponding nozzle, and wherein said flexible plate comprises a gas-permeable resin material, and said wall portion which partly defines said common manifold chamber comprises a gas-impermeable film which prevents permeation of air into the common manifold chamber through the flexible plate.

2. The ink-jet printing head according to claim 1, wherein said cavity unit further comprises, in addition to a first plate serving as said flexible plate, a second plate having a through-hole forming said common manifold chamber, a third plate having a plurality of through-holes forming said plurality of pressure chambers, and a fourth plate having a plurality of communication holes for communication between said pressure chambers and said common manifold chamber, and said first through said fourth plates are laminated on each other.

3. The ink-jet printing head according to claim 2, wherein said second plate is laminated on said first plate such that said through-hole of the second plate is closed at one of opposite openings by the first plate, and said fourth plate is laminated on a side of said second plate remote from said first plate, while said third plate is laminated on a side of said fourth plate remote from said second plate.

4. The ink-jet printing head according to claim 1, wherein said resin material of said flexible plate is a polyimide resin.

5. The ink-jet printing head according to claim 1, wherein said flexible plate has a weak portion which is formed generally along said common manifold chamber and which permits easier deformation of said damper portion than when said flexible plate does not have said weak portion.

6. The ink-jet printing head according to claim 1, wherein said common manifold chamber extends in an X-axis direction in which said plurality of pressure chambers are arranged in a straight row, and a dimension of said damper portion in a Y-axis direction perpendicular to said X-axis direction is larger than that of said common manifold chamber.

7. The ink-jet printing head according to claim 1, wherein said common manifold chamber extends in an X-axis direction in which said plurality of pressure chambers are arranged in a straight row, and a dimension of said damper portion in a Y-axis direction perpendicular to said X-axis direction is smaller than that of said common manifold chamber.

8. The ink-jet printing head according to claim 1, wherein said wall portion of said flexible first plate which constitutes said damper portion has a smaller thickness than the other portion of the flexible first plate.

9. The ink-jet printing head according to claim 1, wherein said gas-impermeable film is formed on surface of said flexible plate opposite the common manifold chamber, wherein said one surface of said flexible plate opposite the common manifold chamber is exposed to the atmosphere.

10. An ink-jet printing head having a cavity unit, said cavity unit comprises:

a plurality of nozzles for ejecting an ink;

a plurality of pressure chambers communicating with the respective nozzles;

a common manifold chamber for distributing the ink into the plurality of pressure chambers; and a flexible plate having said plurality of nozzles and comprising a wall portion which partly defines said common manifold chamber and which constitutes a damper portion, wherein said flexible plate further comprising at least one weak portion which is formed generally along said common manifold chamber and which is configured to permit easier deformation of said damper portion than when said flexible plate does not comprise said at least one weak portion, and wherein said damper portion is configured to absorb a pressure wave of the ink propagating from each selected one of said pressure chambers to said common manifold chamber when the ink in said each selected one of said pressure chamber is pressurized to eject the ink from the corresponding nozzle.

11. The ink-jet printing head according to claim 10, wherein said at least one week portion comprises two weak portions which have respective two straight grooves formed in one surface of said flexible plate on the side of said common manifold chamber, said two straight grooves extending in an X-axis direction along longitudinally extending edges of said common manifold chamber and being located outwards of said longitudinally extending edges as viewed in Y-axis direction perpendicular to said X-axis direction, said two straight grooves defining said damper portion therebetween in said Y-axis direction.

* * * * *